US011164414B2

(12) United States Patent
Baczek

(10) Patent No.: US 11,164,414 B2
(45) Date of Patent: Nov. 2, 2021

(54) SYSTEM AND METHOD FOR PROVIDING SECURE ACCESS

(71) Applicant: CARRIER CORPORATION, Palm Beach Gardens, FL (US)

(72) Inventor: Rafal Baczek, Gdansk (PL)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/831,223

(22) Filed: Mar. 26, 2020

(65) Prior Publication Data

US 2020/0312070 A1 Oct. 1, 2020

(30) Foreign Application Priority Data

Mar. 27, 2019 (EP) ..... 19165481

(51) Int. Cl.
*G07C 9/25* (2020.01)
*G07C 9/28* (2020.01)
*G07C 9/10* (2020.01)

(52) U.S. Cl.
CPC ..... *G07C 9/25* (2020.01); *G07C 9/10* (2020.01); *G07C 9/28* (2020.01)

(58) Field of Classification Search
CPC ..... G07C 9/27; G07C 9/257; H04L 63/10
See application file for complete search history.

(56) References Cited

U.S. PATENT DOCUMENTS 9,923,927 B1 * 3/2018 McClintock ..... H04L 63/108
2007/0094716 A1 * 4/2007 Farino ..... G07C 9/27 726/5
2014/0096210 A1 * 4/2014 Dabbiere ..... G06F 21/316 726/5
2014/0298398 A1 * 10/2014 Neely ..... H04L 63/10 726/1
2015/0227727 A1 * 8/2015 Grigg ..... G06F 21/31 726/4
2016/0248748 A1 * 8/2016 Caterino ..... G07C 9/23
2019/0364050 A1 * 11/2019 Zhang ..... G06F 21/14

FOREIGN PATENT DOCUMENTS

WO 2014140810 A1 9/2014

OTHER PUBLICATIONS

European Patent Office, Extended European Search Report, Application No. 19165481.3-1009, dated Oct. 4, 2019 (7 pp.).

* cited by examiner

*Primary Examiner* — Fabricio R Murillo Garcia
(74) *Attorney, Agent, or Firm* — Cantor Colburn LLP

(57) ABSTRACT

Disclosed is a security system including: a first gateway comprising a security access gateway; a first sensor comprising a security sensor, the first sensor engageable to obtain access through the first gateway; a controller operationally connected to the first gateway and the first sensor, the controller being configured for: rending a first determination that the first sensor senses a first security access credential is being presented, and thereafter: rendering a second determining to monitor for compliance with protocols identifying a sequence and a timing scheme for presenting additional security access credentials; rending a further determination including one of: a determination to grant access if the presenting of additional security access credentials complies with the protocols; and a determination to deny access if the presenting of additional security access credentials fails to comply with the protocols.

17 Claims, 6 Drawing Sheets

SYSTEM AND METHOD FOR PROVIDING SECURE ACCESS

CROSS-REFERENCE TO RELATED APPLICATIONS

This application claims the benefit of European Patent Application No. 19165481.3 filed Mar. 27, 2019, the disclosure of which is incorporated herein by reference in its entirety.

BACKGROUND

The present invention relates to a security system, and in particular examples relates to access control and more specifically to a system and method for providing secure access control based on electronically sensed time dependent activities.

Doors controlled by an access control system may be opened by presenting credentials such as badges, QR (Quick Response) codes, mobile devices, etc. If credentials are misplaced, unauthorized persons may get access and open a secured door. Known security solutions may use parallel or alternate readers, pins and card combinations to increase the security.

BRIEF SUMMARY

Viewed from a first aspect, the invention provides a security system comprising: a first gateway comprising a security access gateway; a first sensor comprising a security sensor, the first sensor being engageable to obtain access through the first gateway; a controller operationally connected to the first gateway and the first sensor, the controller being configured for: rending a first determination that the first sensor senses a first security access credential is being presented, and thereafter: rendering a second determining to monitor for compliance with protocols identifying a sequence and a timing scheme for presenting additional security access credentials; rending a further determination including one of: a determination to grant access if the presenting of additional security access credentials complies with the protocols; and a determination to deny access if the presenting of additional security access credentials fails to comply with the protocols.

Optionally, the controller determines the protocols are complied with upon sensing a plurality of credentials presented in a predetermined order over a predetermined minimum period of time.

Optionally, the protocols are complied with upon sensing a plurality of types of credentials presented in a predetermined order over a predetermined maximum period of time, wherein a first presentation of one of the plurality of types of credentials is uninterrupted and a second presentation of another of the plurality of types of credentials is bifurcated by the first presentation.

Optionally, the controller determines the protocols are complied with upon sensing a travel path along a predetermined pathway.

Optionally, the controller determines the protocols are complied with upon sensing a plurality of controllable features being controlled in a predetermined order.

Optionally, the plurality of controllable features are a respective plurality of door actuators configured to engage a respective plurality of doors.

Optionally, the first gateway is a door and the system operationally controls the first gateway to unlock the door.

Optionally, the first sensor senses an artificial credential and/or a biological credential.

Optionally, the artificial credential is a security card and/or the biological credential includes one or more of a voice, a finger print, and a retina pattern.

Optionally, the controller communicates with the sensor over a wireless network.

BRIEF DESCRIPTION OF THE DRAWINGS

Certain embodiments of the present invention are described below by way of example and with reference to the accompanying figures, in which like reference numerals indicate similar elements, and wherein.

DETAILED DESCRIPTION

Figure 1:
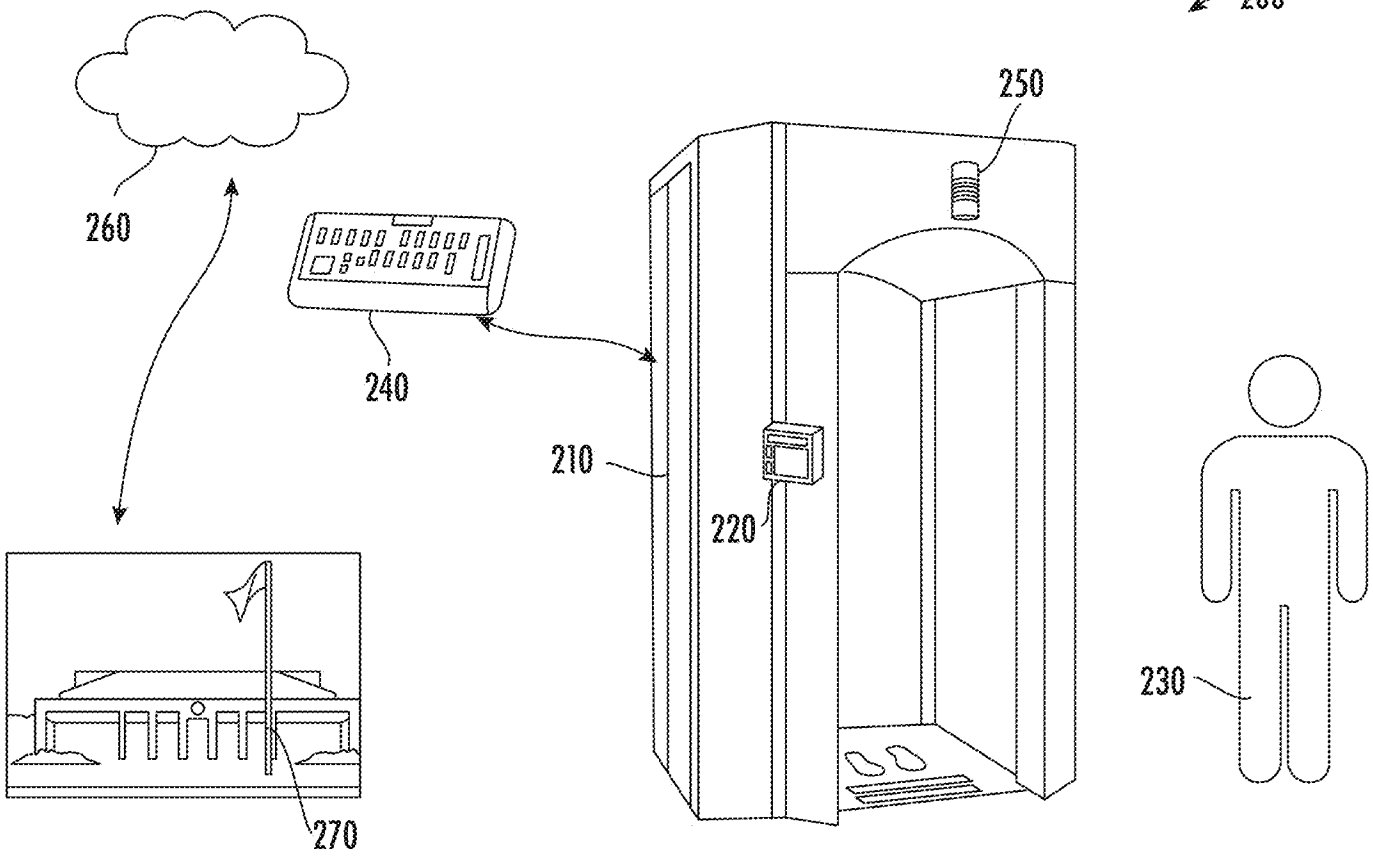
FIG. 1 illustrates components of a security system.

Turning to FIG. 1, disclosed is a security system 200. The security system 200 includes a first gateway 210. The first gateway 210 is a security access gateway, such as an entryway door, lock box, and the like. A first sensor 220 may be included. The first sensor 220 may be a security sensor engageable by a person 230 seeking access through the first gateway 210. The first sensor 220 may be a card scanner or the like. A controller 240 may be provided for operationally controlling features of the system 200. The controller 240 may be operationally connected to the first gateway 210 and the first sensor 220. In a situation where unauthorized access is being sought, the system 200, by means of the controller 240, may be configured to activate visual and/or audible alarm electronics 250 locally as well as over a network 260 with a remote security hub 270.

Figure 2:
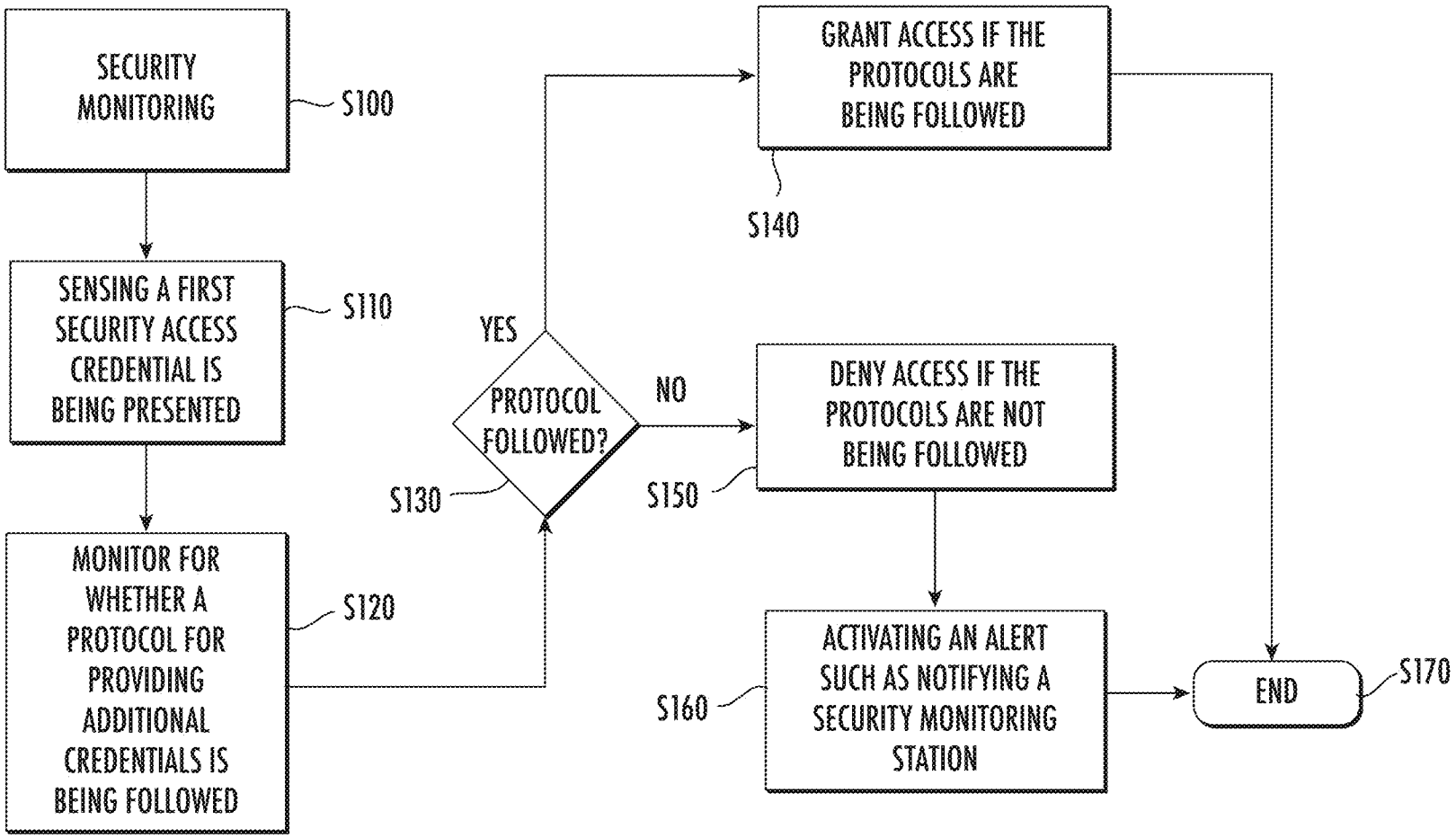
FIG. 2 illustrates an algorithm executed by a security system.

Turning to FIG. 2, the controller may be configured to perform a first step S100 of effecting security monitoring. Step S100 may include step S110 of rendering a first determination that the first sensor senses a first security access credential is being presented. Thereafter the system 200 may perform step S120 of rendering a second determination to monitor for whether a first protocol for presentation sequence and timing scheme of additional credentials is being followed. The term protocol as used herein means the set of rules governing the exchange or transmission of data between devices and the subsequent responses by the devices, such as whether to grant access, as disclosed hereinafter.

Following the monitoring step S120, a decision is made at step S130 to determine whether the first protocol was followed. The controller may execute step S140 of rendering a third determination to grant access if the first protocol is followed. Otherwise, the system 200 may render a fourth determination S150 to deny access. In addition to denying access, the system 200 may render a fifth determination S160 to activate an alert, such as notifying a security monitoring station. At the end of the process that began at step S100, the system 200 ends the process at step S170.

Figure 3:
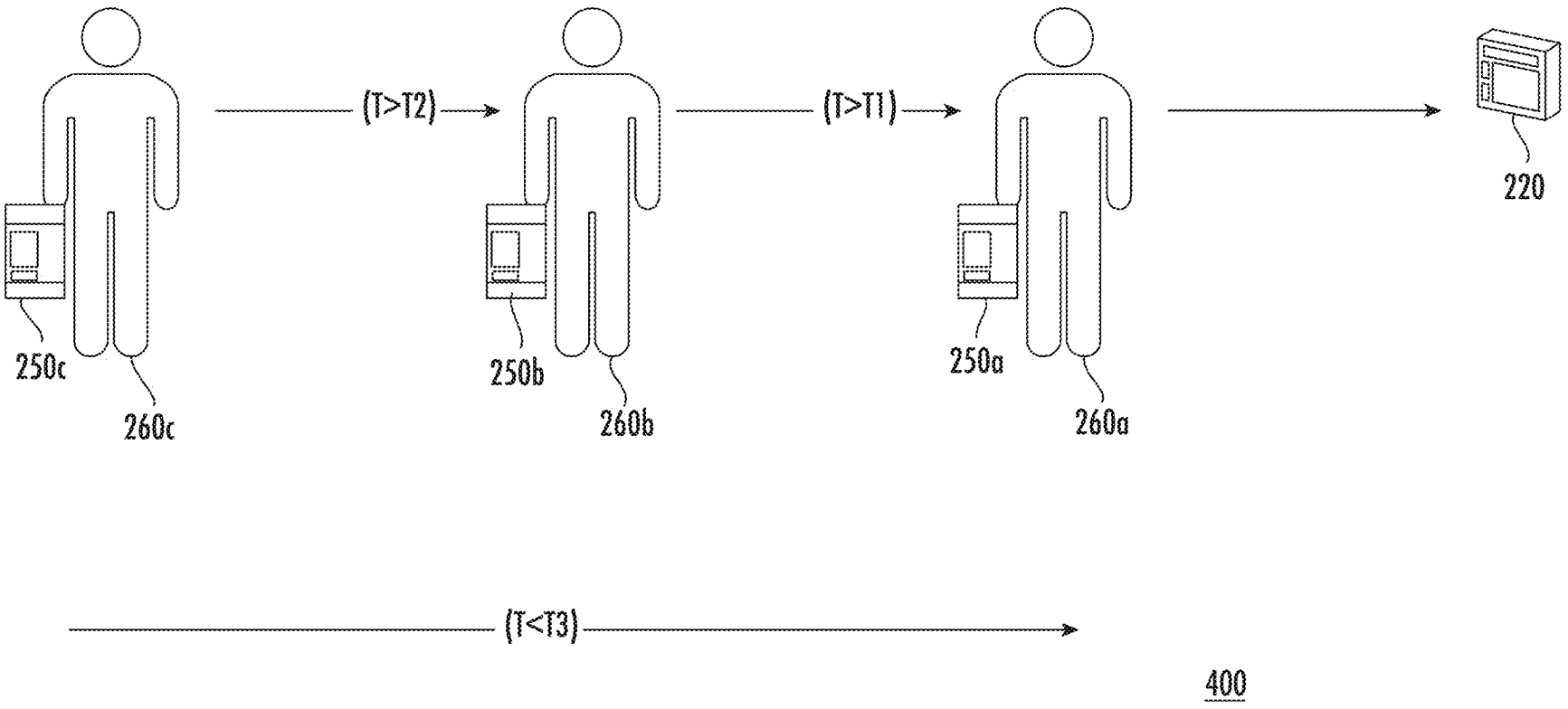
FIG. 3 illustrates an execution of a security access protocol.

According to an execution of a protocol illustrated in FIG. 3, a plurality of credentials may be a plurality of security cards generally referenced as 250 presented by a respective plurality of individuals generally reference as 260. For example, three cards 250*a*, 250*b* and 250*c* are presented by three individuals 260*a*, 260*b*, 260*c*. The protocols may provide for timing pauses between sequential credential presentations. For example, the system 200 may monitor to determine whether, following submission of the first card 250*a*, there is a first pause (T1) of, for example, 15-20 seconds followed by submission of the second card 250*b*. Then, the system 200 may monitor to determine whether, following submission of the second card 250*b*, there is a second pause (T2) of, for example, 15-20 seconds (or another pause duration depending on the protocol), followed by submission of the third card 250*c*. In addition, a total time to provide the cards 250 should be less than time (T3). Mathematically, the time to present the second card is (T>T1) after presenting the first card, the time to present the third card after presenting the second card is (T>T2), and the time to present all cards from the start is (T<T3).

If the specified sequence of cards 250 is provided in the specified time sequence, with the specified pause periods, then the system 200 will grant access. Otherwise, the system 200 may not grant access and, as indicated, may provide an alarm. The protocols applied here may, for example, be applied in a correctional facility to improve security access and control. Even if one or more of the cards 250 are stolen, it is less likely that all cards 250 will be stolen and that the perpetrator will be aware of the protocols for presentation sequence and timing.

Figure 4:
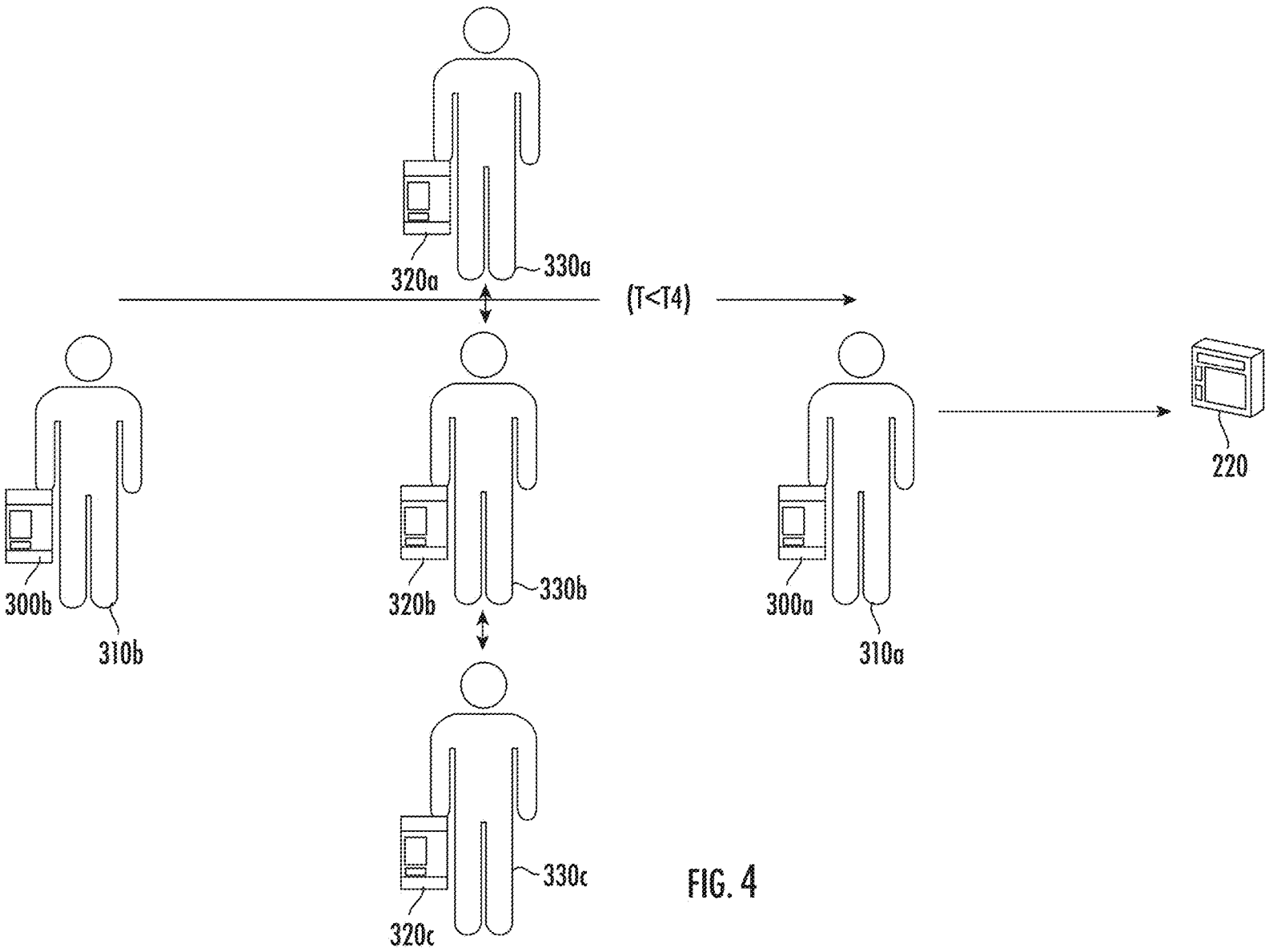
FIG. 4 illustrates another execution of a security access protocol.

According to an execution of a protocol illustrated in FIG. 4, a plurality of credentials provided to the sensor 220 may be a first plurality of security cards generally referenced as 300 presented by a respective first plurality of people generally referenced as 310. In addition, a second plurality of security cards generally referenced as 320 presented by a respective second plurality of people generally reference as 330. More specifically the first plurality of cards 300 may include two cards 300*a* and 300*b* and the first plurality of people 310 may include two people 310*a* and 310*b*. The second plurality of cards 320 may include three cards 320*a*, 320*b* and 320*c* and the second plurality of people 330 may include three people 330*a*, 330*b* and 330*c*.

The first plurality of security cards 300 may have a different classification than the second class of security cards 320. For example, the first plurality of people 310 may be escorts while the second class of people 330 may be executives. The protocols applied by the system 200 may provide for a maximum amount of timing (T4), which may be thirty seconds, between sequential presentations of the first class of cards 300*a*. Mathematically, the total time for the escorts 310 to present security cards 300 should be (T<T4). The protocols may provide for a presentation of the second class of cards 320 in any order so long as, for example, the second class of cards 320 are all provided between presentation of the first class of cards 300. These protocols may provide an assurance that an appropriate number of identified escorts 310 accompany the executives 330.

Figure 5:
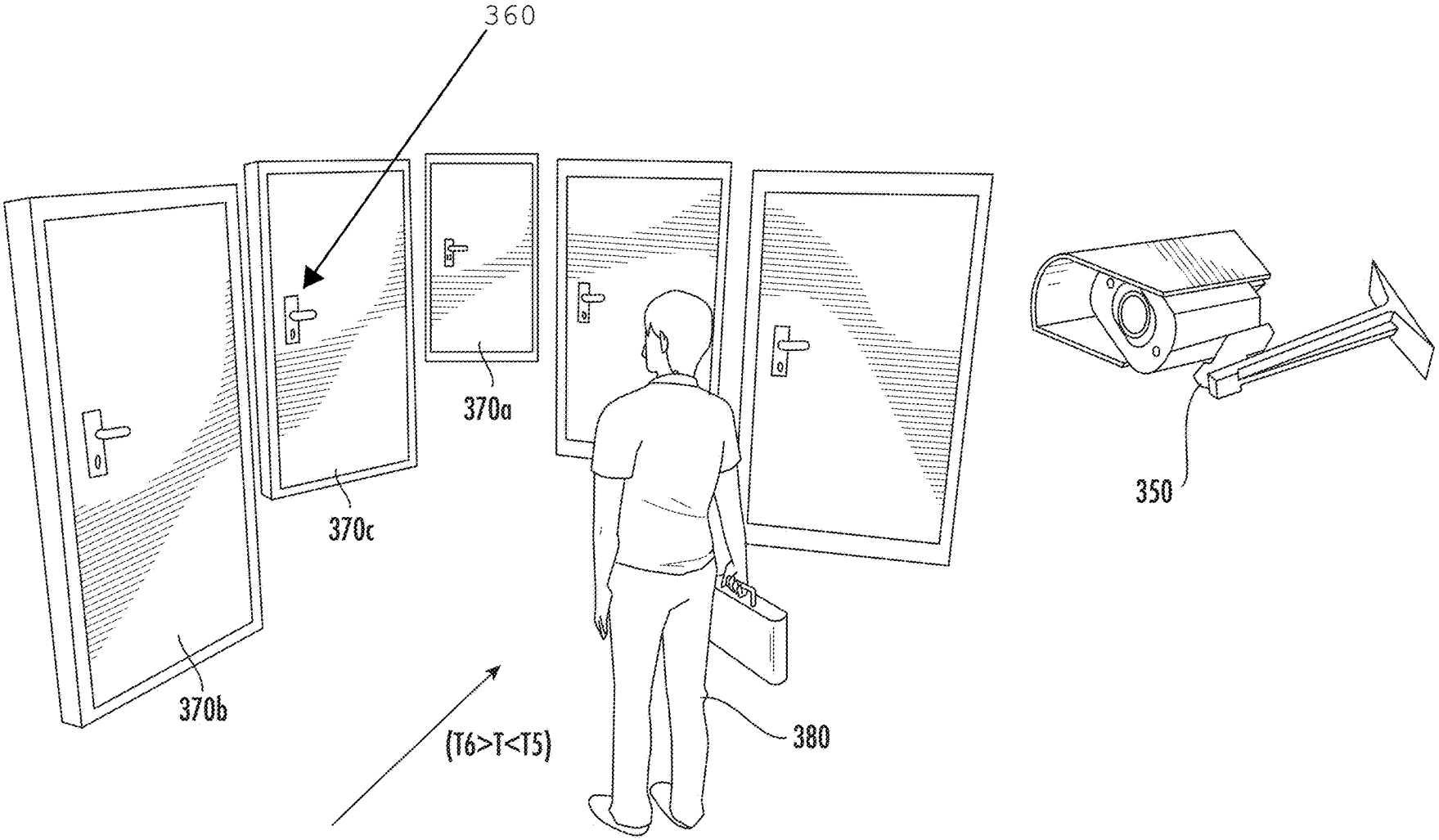
FIG. 5 illustrates another execution of a security access protocol.

According to an execution of a protocol illustrated in FIG. 5, in one embodiment the protocols may include sensing with a surveillance camera 350 a plurality of controllable features. The protocols may require controlling the features in a predetermined order and within a predetermined period of time and/or including a scheme of timing pauses. The plurality of controllable features may be a respective plurality of door actuators generally referenced as 360 and configured to engage a respective plurality of doors generally referenced as 370. The protocols may require the person 380 attempting access of a first door 370*a* to first engage a second door 370*b* and a third door 370*c* in a particular sequence and within a particular time (T5), which may include a predetermined pause (T6). Mathematically, the time for opening the doors 370*b* and 370*c*, to obtain access to the first door 370*a*, may be (T6>T<T5). For example, in a vault with a locked safety box and various other door controllers, the system may monitor to determine whether the various other door controllers are actuated in a specified order before allowing access to contents of the safety box.

In some arrangements the first gateway is a door and the system operationally controls the first gateway to unlock the door. Or, as indicated, the door may lead to a secured room, such as a vault, and/or to a lock box within a vault. The first sensor may sense an artificial credential and/or a biological credential. The artificial credential may be a security card as indicated above and the biological credential may include one or more of a voice, a finger print, and a retina pattern.

The above examples disclose door authorization protocols that may require defining the chain of credentials needed to be presented on the sensor/reader and time-frame tolerance between presenting such credentials. The sequence and time-frame tolerance identified by the protocols may become part of the credentials. The above disclosed door authorization protocols are not intended to be limiting. Activities may be scheduled in a serial, a parallel or a mixed form, but still use one sensor, or more sensors as may be predetermined. With the above disclosure, security may be increased, a scaling up or down for an order of operations may be flexible and the implementation, operation and updating thereof may be inexpensive.

Various uses of the disclosed examples may include, for example, providing access control decisions based on a sequence of events and/or interactions with an access control system as identified above. For increased efficiency access control protocols may be correlated with a time frame between sequenced steps, and the access control protocols may utilize one or more types of access and intrusion detection equipment. Sequence and time-frame for sensing a presentation of credentials may violate the protocols, and then the access control system may sound an alarm or refuse access. In one embodiment a sequence may be intentionally broken by employee in order to sound alarm in an emergency situation.

Figure 6:
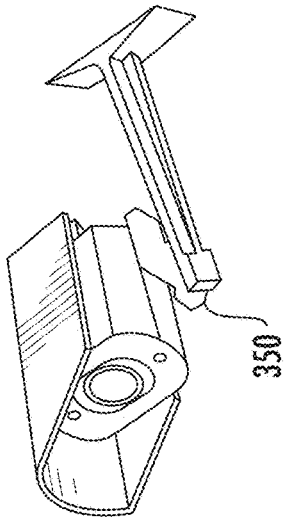
FIG. 6 illustrates another execution of a security access protocol.
Figure 6:
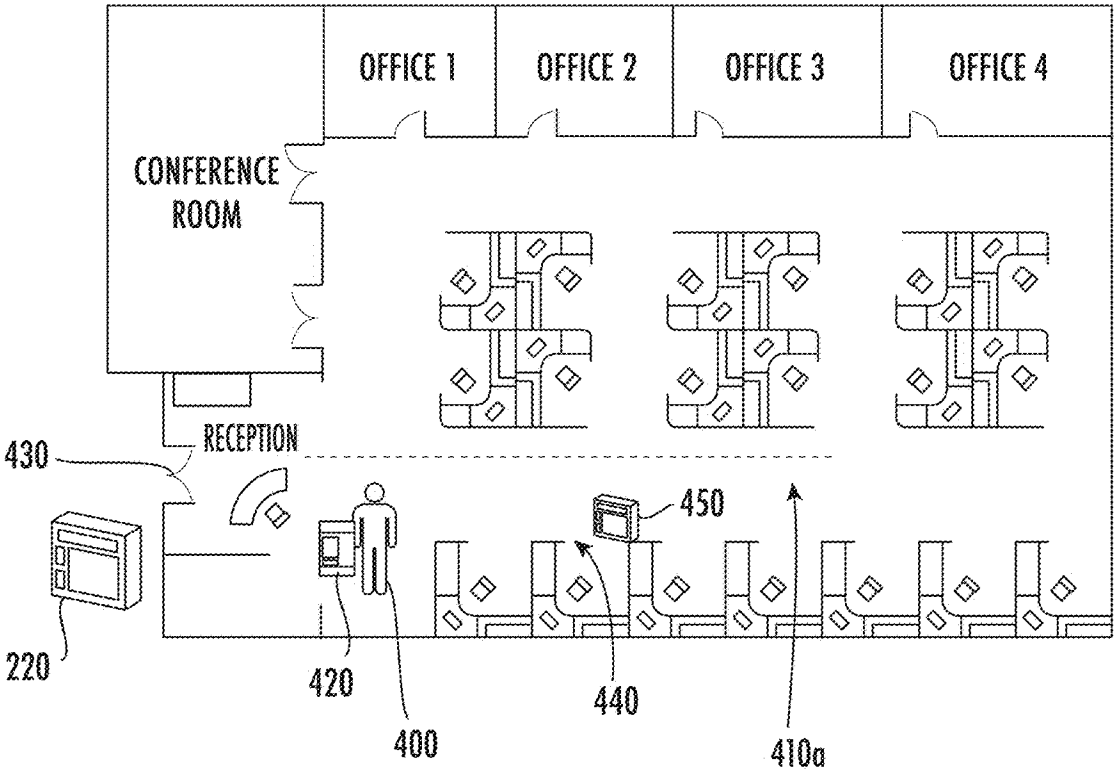

Turing to FIG. 6, in an execution of a protocol in a laboratory or a military area, the system 200 may confirm an identity of a person 400 by following expected movement of along expected paths generally referred to as 410 as monitored by the security camera 350. The person 400 may presenting a security card 420 and enter a personal identification number (PIN) in the sensor 220 at a first door 430. A camera 350 may sense the face of the person 400. Then the person 400 may walk along a predetermined path 410*a* to an internal door 440 and again present the card 420 to an addition card sensor 450. Then the system may open the internal door 440. At this time, the person 400 may be allowed to travel to different doors that are related with their security card 420. Automatically moving sensors such as video sensor 350 that travel along paths walked by the person 400 may be used.

Remaining with FIG. 6, in another execution of a protocol the person 400, who may be an employee, may wait a predetermined time, such as 30 seconds, after approaching the sensor 220 (or 450) before being able to present biometric "data" to the sensor 220 (or 450) at the door 430 (or the door 440). Depending on the biometrics presented, the protocols executed by the system may provide for different allowed paths 410 for different people, which may change depending on a time of day and may limit access to a subset of paths 410.

The protocols for tracking movement of a person in order to grant access or set off an alarm within a building may be applied outside as well. As within a building, walking paths in open spaces may be pre-selected in certain locations based on security requirements. As with an indoor environment, a security camera (e.g., 350 in FIG. 6) may follow the person in a different location for a predetermined duration. A yet further the camera may follow the person in a different location for a predetermined duration. If a timing along a traveled path is violated then a security alarm may be sound. This may be helpful in a hospital to track patients.

A silent alarm may activate in a bank upon comparing expected employee behavior with a current "unusual" behavior. This may be implemented in places when employee may be unable to directly notify security of ongoing assault. If the employee needs to activate a silent alarm, then taking predetermined steps in an untimely way (too fast or too slow) may set off an alarm. For example opening and closing of a door or money box may be required to follow protocols similar to those associated with the embodiment identified in FIG. 5, above. In addition or as an alternative walking along travel paths may require compliance with security access protocols as indicated in FIG. 6, above. Purposeful violation of protocols may lead to purposeful setting off an alarm to notify, for example, law enforcement authorities.

Disclosed embodiments identify one or more controllers and circuits that may utilize processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present invention is not thus limited. Rather, the present invention can be modified to incorporate any number of variations, alterations, substitutions, combinations, subcombinations, or equivalent arrangements not heretofore described, but which are commensurate with the scope of the present invention as defined by the claims. Accordingly, the present invention is not to be seen as limited by the foregoing description, but is only limited by the scope of the appended claims.

What is claimed is:

1. A security system comprising:

a first gateway comprising a security access gateway;

a first sensor comprising a security sensor, the first sensor being engageable to obtain access through the first gateway;

a controller operationally connected to the first gateway and the first sensor, the controller being configured for:

rendering a first determination that the first sensor senses a first security access credential is being presented, and thereafter:

rendering a second determination to monitor for compliance with protocols identifying a sequence and a timing scheme for presenting additional security access credentials;

rendering a further determination including one of:

a determination to grant access if the presenting of additional security access credentials complies with the protocols; and a determination to deny access if the presenting of additional security access credentials fails to comply with the protocols;

wherein the controller determines the protocols are complied with upon sensing a plurality of types of credentials presented in a predetermined order over a predetermined maximum period of time, wherein a first presentation of one of the plurality of types of credentials is uninterrupted and a second presentation of another of the plurality of types of credentials is bifurcated by the first presentation, and wherein:

the plurality of types of credentials are security cards having different classifications;

the system provides for a maximum amount of timing between sequential presentations of a first class of cards; and the system provides for a presentation of a second class of cards in any order so long as the second class of cards are provided between presentation of the first class of cards.

2. The system of claim 1, wherein:

the controller determines the protocols are complied with upon sensing a plurality of credentials presented in a predetermined order over a predetermined minimum period of time.

3. The system of claim 1, wherein:

the controller determines the protocols are complied with upon sensing a travel path along a predetermined pathway.

4. The system of claim 1, wherein:

the controller determines the protocols are complied with upon sensing a plurality of controllable features being controlled in a predetermined order.

5. The system of claim 4, wherein the plurality of controllable features are a respective plurality of door actuators configured to engage a respective plurality of doors.

6. The system of claim 1, wherein the first gateway is a door and the system operationally controls the first gateway to unlock the door.

7. The system of claim 1, wherein the first sensor senses an artificial credential and/or a biological credential.

8. The system of claim 7, wherein the artificial credential is a security card and/or the biological credential includes one or more of a voice, a finger print, and a retina pattern.

9. The system of claim 1, wherein the controller communicates with the sensor over a wireless network.

10. A method of implementing security protocols at a security gateway of a security system by a controller for the security system, the method comprising:

rendering a first determination that a first sensor operationally positioned at the security gateway senses a first security access credential is being presented at the security access gateway, and thereafter:

rendering a second determination to monitor for compliance with protocols identifying a sequence and a timing scheme for presenting additional security access credentials;

rendering a further determination including one of:

a determination to grant access if the presenting of additional security access credentials complies with the protocols; and a determination to deny access if the presenting of additional security access credentials fails to comply with the protocols;

wherein the controller determines the protocols are complied with upon sensing a plurality of types of credentials presented in a predetermined order over a predetermined maximum period of time, wherein a first presentation of one of the plurality of types of credentials is uninterrupted and a second presentation of another of the plurality of types of credentials is bifurcated by the first presentation, and wherein:

the plurality of types of credentials are security cards having different classifications;

the system provides for a maximum amount of timing between sequential presentations of a first class of cards; and the system provides for a presentation of a second class of cards in any order so long as the second class of cards are provided between presentation of the first class of cards.

11. The method of claim 10 wherein:

the controller determines the protocols are complied with upon sensing a plurality of credentials presented in a predetermined order over a predetermined minimum period of time.

12. The method of claim 10, wherein:

the controller determines the protocols are complied with upon sensing a plurality of controllable features being controlled in a predetermined order.

13. The method of claim 12, wherein the plurality of controllable features are a respective plurality of door actuators configured to engage a respective plurality of doors.

14. The method of claim 10, wherein:

the security gateway is a door; and the system operationally controls the first gateway to unlock the door.

15. The method of claim 10, wherein the first sensor senses one or more of an artificial credential and a biological credential.

16. The method of claim 15, wherein the artificial credential is a security card and/or the biological credential includes one or more of a voice, a finger print, and a retina pattern.

17. The method of claim 10, wherein the controller determines the protocols are complied with upon sensing a travel path along a predetermined pathway.

* * * * *